US006250376B1

(12) United States Patent
Hendrix

(10) Patent No.: US 6,250,376 B1
(45) Date of Patent: Jun. 26, 2001

(54) HEAT EXCHANGING ROLL

(75) Inventor: Gottfried Hendrix, Wesel (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/281,257

(22) Filed: Mar. 30, 1999

(30) Foreign Application Priority Data

Apr. 1, 1998 (DE) ..... 198 14 597

(51) Int. Cl.[7] ..... F28F 5/02; F28D 11/02; F26B 11/02

(52) U.S. Cl. ..... 165/90; 165/89; 492/46; 34/124

(58) Field of Search ..... 165/89, 90; 492/46; 34/124, 125

(56) References Cited

U.S. PATENT DOCUMENTS

| | | | | |
|---|---|---|---|---|
| 1,820,074 | * | 8/1931 | Kilborn | 165/89 |
| 1,897,613 | * | 2/1933 | Jensen | 165/90 |
| 2,883,151 | * | 4/1959 | Dolida | 165/104.25 |
| 3,120,867 | * | 2/1964 | Nash | 165/90 |
| 3,401,745 | * | 9/1968 | Pato et al. | 165/89 |
| 3,711,074 | * | 1/1973 | Sugg | 165/89 |
| 4,282,638 | * | 8/1981 | Christ et al. | 492/46 |
| 5,933,988 | * | 8/1999 | Adler | 492/46 |
| 6,095,237 | * | 8/2000 | Haag | 165/89 |

FOREIGN PATENT DOCUMENTS

| | | |
|---|---|---|
| 225767 | 8/1985 | (DE) . |
| 197 56 152 | 12/1997 | (DE) . |
| 196 24 737 | 1/1998 | (DE) . |
| 198 09 080 | 3/1998 | (DE) . |

* cited by examiner

*Primary Examiner*—Ira S. Lazarus
*Assistant Examiner*—Tho Van Duong
(74) *Attorney, Agent, or Firm*—Greenblum & Bernstein, P.L.C.

(57) ABSTRACT

A heat exchange roll. The roll includes a roll jacket, and a heat exchanger mounted inside the roll jacket. A supply mechanism controls an inflow and outflow of an external heat transfer fluid to a primary side of the heat exchanger. An internal heat transfer fluid has a fluid path between an inner portion of the roll jacket and a secondary side of the heat exchanger. A pump mechanism pumps the internal heat transfer fluid over the fluid path.

26 Claims, 3 Drawing Sheets

HEAT EXCHANGING ROLL

CROSS REFERENCE TO RELATED APPLICATIONS

The present application claims priority under 35 U.S.C. § 119 of German Patent Application No. 198 14 597.7, filed Apr. 1, 1998, the disclosure of which is expressly incorporated by reference herein in its entirety.

BACKGROUND OF THE INVENTION

1. Field of the Invention

The present invention is directed to a roll with a heat exchanger. More specifically, the present invention is directed to a roll having a heat exchanger disposed inside the roll jacket. The heat exchanger connects with a supply mechanism for inflow and outflow of an external heat transfer fluid to its primary side. A secondary side of the heat exchanger and an inner surface of the roll jacket support an internal heat transfer fluid.

2. Discussion of the Background Information

DD 225 767 A1 discloses rolls used in calenders to process paper webs or other material webs. Rolls cooperate with adjacent rolls to form nips therebetween. It is known in such arrangements that it is often preferable to heat or cool the material web, either at a nip or away from such a nip.

The need to cool the roll is not limited to situations in which only the material web needs to be cooled, but includes the roll itself; for example, when the roll has an elastic coating, heat builds up during fulling of the elastic coating, and must be dissipated to prevent damage to the coating and/or web. In other applications, the roll may need to be heated when the material web is to be exposed to an elevated pressure and/or an elevated temperature. In such cases, it is known to introduce a heat transfer fluid, for example, cooling water or heating steam, into the roll using a heat exchanger.

The above noted DD 225 767 A1 discloses a fluid path for an internal heat transfer fluid. The heat transfer fluid is present in a gas phase and in a liquid phase. It condenses on the heat exchanger and is then thrown against the inside wall of the roll jacket, where it evaporates. The resultant steam condenses when it arrives at the heat exchanger, whereupon the process repeats itself.

A drawback of such a heat exchanger is that it operates only with certain temperature differentials, and only for cooling the roll. It can also be controlled only to a limited extent.

SUMMARY OF THE INVENTION

Accordingly, the present invention is intended to overcome the drawbacks of the prior art. To meet that intention, the present invention provides a roll with a heat exchanger that provides more versatility in temperature control, and can be used for both heating and cooling a roll.

According to various features of the invention, a pump is provided inside the roll, which at least partially circulates fluid from an inner surface of the roll to the heat exchanger. Consequently, controlling the circulation of the internal heat transfer fluid using the pump is possible. Temperature control is not dependent on the presence of the heat transfer fluid in a specific form (e.g., whether it can evaporate under operating conditions). The flow of heat from the roll jacket to the heat exchanger, or in the opposite direction, is controllable over relatively large areas.

Centrifugal force partially circulates the internal heat transfer fluid, while only a feed path for the external heat transfer fluid is necessary. Since the external heat transfer fluid flows only through the heat exchanger, but not through the roll jacket, lower demands are made on the external heat transfer fluid.

Unlike the prior art, the present invention roll may also be used as a heating roll. The roll can also be operated with lower temperatures, at which the steam condenses, since the steam has to be guided only through the heat exchanger. Older rolls can also be retrofit with this new design.

Preferably, the pump mechanism is mounted on the roll and rotates therewith. Accordingly, no moving connections are necessary in the path of the internal heat transfer fluid, with a corresponding reduced chance of leaks. Mounting the pump mechanism is also simplified, as movable mounts are unnecessary.

In an exemplary embodiment, the pump mechanism is disposed on one end of the roll for maintenance purposes. However, adequate space is still available on the end of the roll for other purposes.

Also in the exemplary embodiment, the pump mechanism surrounds a roll journal in a ring shape. This uniformly distributes the weight of the pump mechanism around the circumference of the roll, minimizing any imbalance.

In an exemplary embodiment, the pump mechanism arrangement has at least one pump disposed as far from the radial center of the roll as possible. The pump will thus not have to overcome centrifugal force to circulate the internal heating transfer fluid. In most cases, centrifugal force will return the internal heat transfer fluid to the pump. In any case, with this design, the internal heat transfer fluid is always present at the pump intake.

Preferably, the pump has a working element actuatable from outside the roll jacket. Depending on the design of the pump, the working element can be a piston that moves back and forth, or a rotary element (e.g., an impeller) which rotates. Other types of pumps can also be used, e.g., gear-type pumps or centrifugal pumps. The working element must be driven in some manner in all pumps. If the drive is handled externally, i.e., from outside the roll, the roll does not have to be supplied with any additional energy to drive the pump.

The working element preferably cooperates with a stationary drive mechanism during rotation of the roll. Consequently, rotation of the roll provides relative movement between the pump and the drive arrangement. This relative movement drives the working element of the pump. For example, with a rotary pump in which the working element rotates, it is possible to have a drive wheel (which is in torque transferring connection with the working element) roll on a friction surface or a toothed surface surrounding the pump arrangement. The drive wheel rotates proportionally with the speed of the roll. Thus, the pump output increases at higher rotational speeds, which is often necessary, since higher rotational speeds have a correspondingly higher amount of material web to be treated per time unit.

When the pump has a different design, such as (for example) a piston pump, the piston or a plunger connected thereto may be guided along a cam. If the plunger or the piston is loaded with a reset force (for example, a reset spring) it suffices for the cam to act on the plunger from one direction. The plunger may also be actuated in that the pump mechanism is in contact with a rotating drive wheel when the roll rotates. Whenever the plunger comes under the drive wheel, it is forced inward. It is possible to achieve the same effect, for example, by surrounding the pump mechanism with a circulating belt, which is raised from the pump mechanism in at least one position. There, the plunger can be forced back out of the pump. For more details, reference is made to the subsequently published German patent applications 197 56 152 and 198 09 080.

Preferably, the external heat transfer fluid is fed centrally to the heat exchanger, and the outflow takes place radially farther out. This has the advantage that centrifugal force provides at least part of the energy needed to circulate the fluid.

In an exemplary embodiment, the secondary side of the heat changer has a plurality of tubes in parallel with an axis of the roll, disposed in a heat exchanger chamber and which connect with a feed connection. This provides a relatively large surface for the heat transfer from the external to the internal heat transfer fluid, or vice versa. With a heated roll, the arrangement has the advantage that steam (the preferable external heat transfer fluid) condenses on the outside of the tubes to deliver heat to the internal heat transfer fluid flowing through the tubes. Because of the rotation of the roll, any condensate is immediately thrown off the tubes, such that it does not interfere with the heat transfer. Consequently, the heat transfer surfaces are "self-cleaning."

In another exemplary embodiment, the heat exchanger has a distribution tube, through which the internal heat transfer fluid flows. The distribution tube surrounds a flow path of the external heat transfer fluid, and has a plurality of openings distributed in the circumferential and the axial direction of the distribution tube. Such an arrangement is preferably used with cooling rolls. The pump mechanism delivers the internal heat transfer fluid to the distribution tube, where contact with the heat exchanger cools it. The cooled internal heat transfer fluid is then thrown or sprayed outward through the openings against the radial inside of the roll jacket, partially under the pressure of the pump and the influence of centrifugal force.

According to an exemplary embodiment of the invention, there is provided a roll including a roll jacket, and a heat exchanger mounted inside the roll jacket. A supply mechanism controls an inflow and outflow of an external heat transfer fluid to a primary side of the heat exchanger. An internal heat transfer fluid has a fluid path between an inner portion of the roll jacket and a secondary side of the heat exchanger. A pump mechanism pumps the internal heat transfer fluid over the fluid path.

Preferably, the pump mechanism is attached to the roll and rotates therewith, is disposed on one end of the roll, and encircles a roll journal.

The pump mechanism also preferably includes at least one pump, positioned along the outmost radial portion of the fluid path. The at least one pump preferably has an externally actuable working element that cooperates during rotation of the roll with a stationary drive mechanism to induce pumping action.

The above-noted supply mechanism preferably includes a centrally disposed feed path along which the external heat transfer fluid travels, and a discharge path for discharging the external heat transfer fluid positioned further radially outward than the feed path.

In accordance with a feature of the exemplary embodiment, a plurality of tubes are mounted inside the heat exchanger parallel to the roll, and connect to the feed path. In accordance with another feature, the heat exchanger has a distribution tube, through which the internal heat transfer fluid can flow, which surrounds a flow path of the external heat transfer fluid, whereby the distribution tube has a plurality of openings, which are distributed in a circumferential direction and an axial direction of the roll jacket.

According to another embodiment of the invention, there is provided a roll including a roll jacket and a heat exchanger mounted inside the roll jacket. A distribution tube surrounds the heat exchanger and has at least one hole along a circumference thereof. A pump mechanism is adapted to transfer an internal heat exchange fluid from inside the roll jacket to the distribution tube.

In accordance with various features of the above embodiment, the pump mechanism preferably includes a plurality of pumps mounted in a ring about the roll jacket. The heat exchanger and distribution tube preferably rotate with the roll jacket. The heat exchanger may include a feed path centrally disposed in the roll jacket, and a discharge tube mounted about the feed tube, wherein an outer surface of the discharge tube is a heat transfer interface between the internal and external heat transfer fluids. Rotation of the roll jacket may operate the pumping mechanism, such that an operational speed of the pumping mechanism is preferably proportional to a rotational speed of the roll jacket.

According to another embodiment of the present invention, there is provided a roll having a roll jacket having a least one bore therein, and a heat exchanger mounted inside the roll jacket. A plurality of internal heat transfer fluid tubes are disposed inside the heat exchanger. A pump mechanism is adapted to transfer an internal heat exchange fluid from the at least one bore to the plurality of internal heat transfer fluid tubes.

Further features of the above embodiment are preferable provided. The pump mechanism may include a plurality of pumps mounted in a ring about the roll jacket. The heat exchanger and plurality of internal heat transfer tubes preferably rotate with the roll jacket. The heat exchanger preferably includes a feed path centrally disposed in the roll jacket, and at least one discharge path from the heat exchanger, wherein an outer surface of the plurality of internal heat transfer fluid tubes is a heat transfer interface between the internal and external heat transfer fluids. Rotation of roll jacket may operate the pumping mechanism, such that an operational speed of the pumping mechanism is proportional to a rotational speed of the roll jacket.

BRIEF DESCRIPTION OF THE DRAWINGS

The present invention is further described in the detailed description that follows, in reference to the noted plurality of drawings by way of non-limiting examples of exemplary embodiments of the present invention, in which like reference numerals represent similar parts through the several views of the drawings, and wherein.

DESCRIPTION OF THE PREFERRED EMBODIMENT OF THE INVENTION

The particulars shown herein are by way of example and for purposes of illustrative discussion of the exemplary embodiments of the present invention only, and represents in the cause of providing what is believed to be the most useful and readily understood description of the principles and conceptual aspects of the invention. In this regard, no attempt is made to show structural details of the invention in more detail than necessary for the fundamental understanding of the invention, the description taken with the drawings making apparent to those skilled in the art how the several forms of the invention may be embodied in practice.

Figure 1:
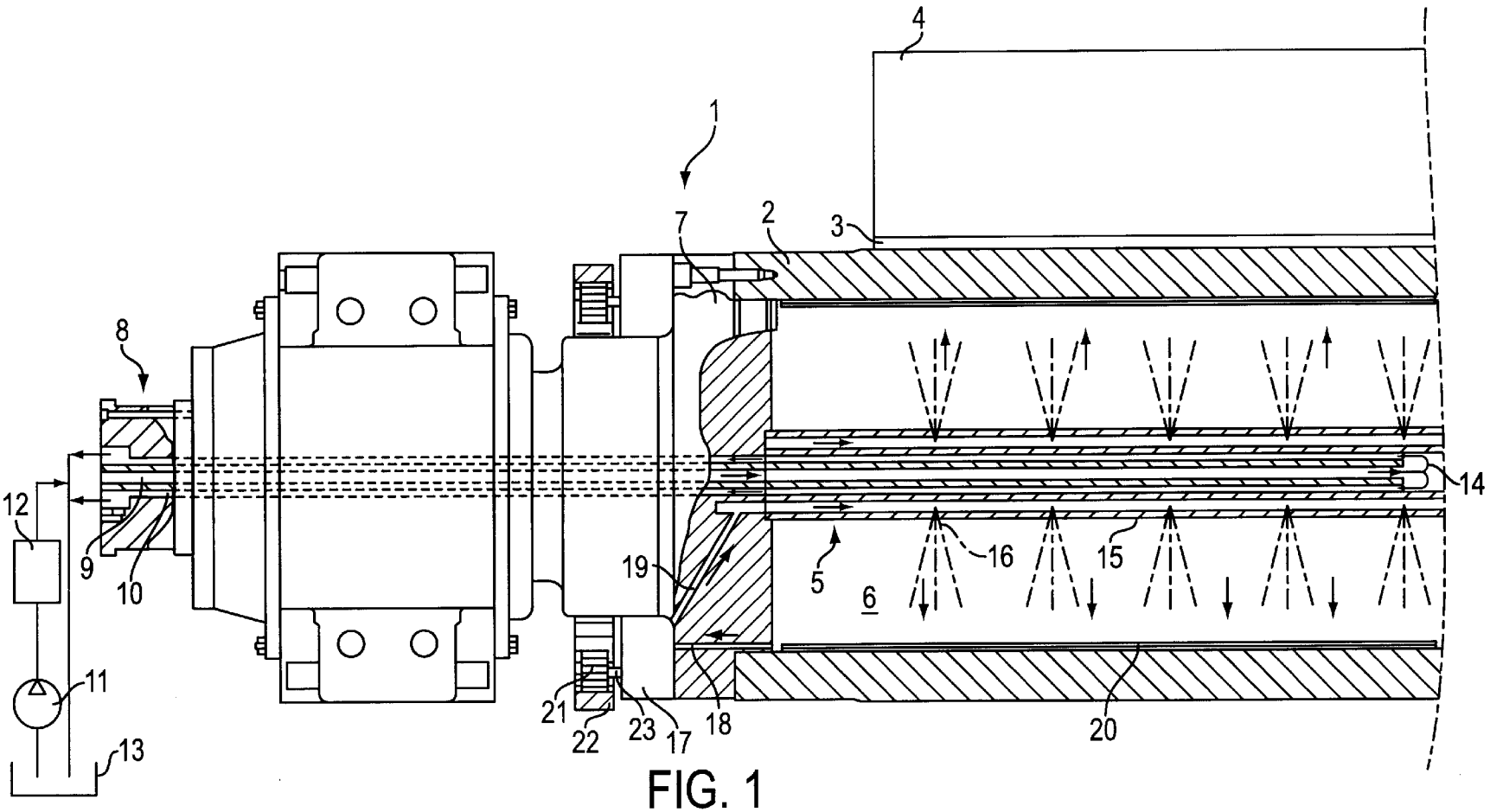
FIG. 1 is a lateral cross-section of an end of a roll according to an exemplary embodiment of the present invention.

Referring now to FIG. 1, the left end of a roll 1, preferably a cooling roll, is shown. Roll 1 has a roll jacket 2 with an elastic coating 3. Roll 1 cooperates with an opposing roll 4 to process a material web (not shown). Over time, coating 3 is periodically fulled and builds up heat which must be dissipated.

A heat exchanger 5 is centrally disposed in the interior of the roll jacket 2, i.e., in a cavity 6 defined by the inner surface of roll jacket 2. End plates 7 bolted onto the roll jacket 2 seal cavity 6 at both ends, such that cavity 6 is fluid-tight. Heat exchanger 5 connects to a supply device 8 for receiving and removing an external heat transfer fluid. Heat exchanger 5 is mounted in roll 1, such that it rotates with roll jacket 2.

Supply device 8 includes a feed line 9 feeding an external heat transfer medium (e.g., cooled water) and a discharge line 10 for removing the water. Feed line 9 aligns with the axis of rotation of roll 1. Discharge line 10 coaxially surrounds feed line 9 such that at a turning point 14 (which may be disposed at the opposite end of roll 1), there is a slight delivery effect due to the centrifugal force.

A pump 11, which supplies feed line 9 via a control unit 12, and a tank 13, into which the external heat transfer fluid is pumped back again, are depicted schematically in FIG. 1. Control unit 12 and/or the pump 11 control how much external heat transfer fluid flows through the heat exchanger 5.

A distribution tube 15 surrounds discharge line 10. Discharge tube 15 has openings 16 along its surface, preferably evenly distributed over the circumference and axial length of discharge tube 15.

A pump mechanism is mounted (preferably bolted) onto the end of the roll 1, i.e., on the axial exterior of one of the end plates 7. Pump mechanism 17 communicates via a feed channel 18 with cavity 6. Feed channel 18 is disposed such that one end opens into cavity 6 in alignment with the radial inside wall of roll jacket 2. Feed channel 18 is connected to the "vacuum connection" end of pump mechanism 17, while a "delivery connection" end of pump mechanism 17 communicates with distribution tube 15 via a channel 19.

Pump mechanism 17 preferably includes several pumps disposed substantially equidistantly around the circumference of roll jacket 2.

During operation, a fluid 20 (i.e., the internal heating fluid, preferably water) is present in the cavity 6. When roll 1 rotates, centrifugal force forces fluid 20 against the inner surface of roll jacket 2. Pump mechanism 17 then suctions the collected fluid 20 out via feed channel 18, and pushes the same to distribution tube 15 through the channel 19 to flow along the outside of discharge line 10.

Since fluid 20 has a higher temperature than the external heat exchange fluid inside discharge line 10 (in this embodiment), heat transfers from fluid 20 to the external heat transfer fluid through the surface of discharge line 10. Under a partial pressure from pump 17 and partial pressure from centrifugal force, the now cooled fluid 20 exits distribution tube 15 through openings 16 to spray against the inside wall of the roll jacket 2. If openings 16 are small enough, this causes an atomization dispersion, or at least spraying of the fluid 20, such that the cooled fluid can even better absorb heat from roll jacket 2.

In the present exemplary embodiment, pumps are uniformly distributed along the circumference of roll jacket 2. Each individual pump is preferably a rotary pump, e.g., a sliding-vane pump. Each pump has a gear 21 as a drive element, which engages with a stationary toothed ring 22. When roll 1 rotates, the gears 21 rolls in the toothed ring 22 to drive the rotary pump via a shaft 23.

The pumps 17 are positioned relatively far out radially, i.e., at least as far as the radially outermost part of the path of fluid 20. Accordingly, the pumps do not have to draw against centrifugal force, but only to deliver against the centrifugal force, since internal heat transfer fluid 20 must be forced radially inward again to arrive at heat exchanger 5.

Toothed ring 22 and gear 21 form a drive mechanism, which drives pump mechanism 17 from the outside as a function of the rotational speed of the roll 8, i.e., the faster roll 1 rotates, the greater the driving power, and thus the delivery rate, of pumping mechanism 17. This effect is quite beneficial, since higher working speeds carry a higher cooling requirement.

As appropriate, toothed ring 22 may be driven at a preselected speed in the same direction, or in the opposite direction, as roll 1, to set different delivery rates for pump mechanism 17. Instead of a toothed ring, providing a friction surface on which the drive wheel rolls under frictional engagement is also possible.

Figure 2:
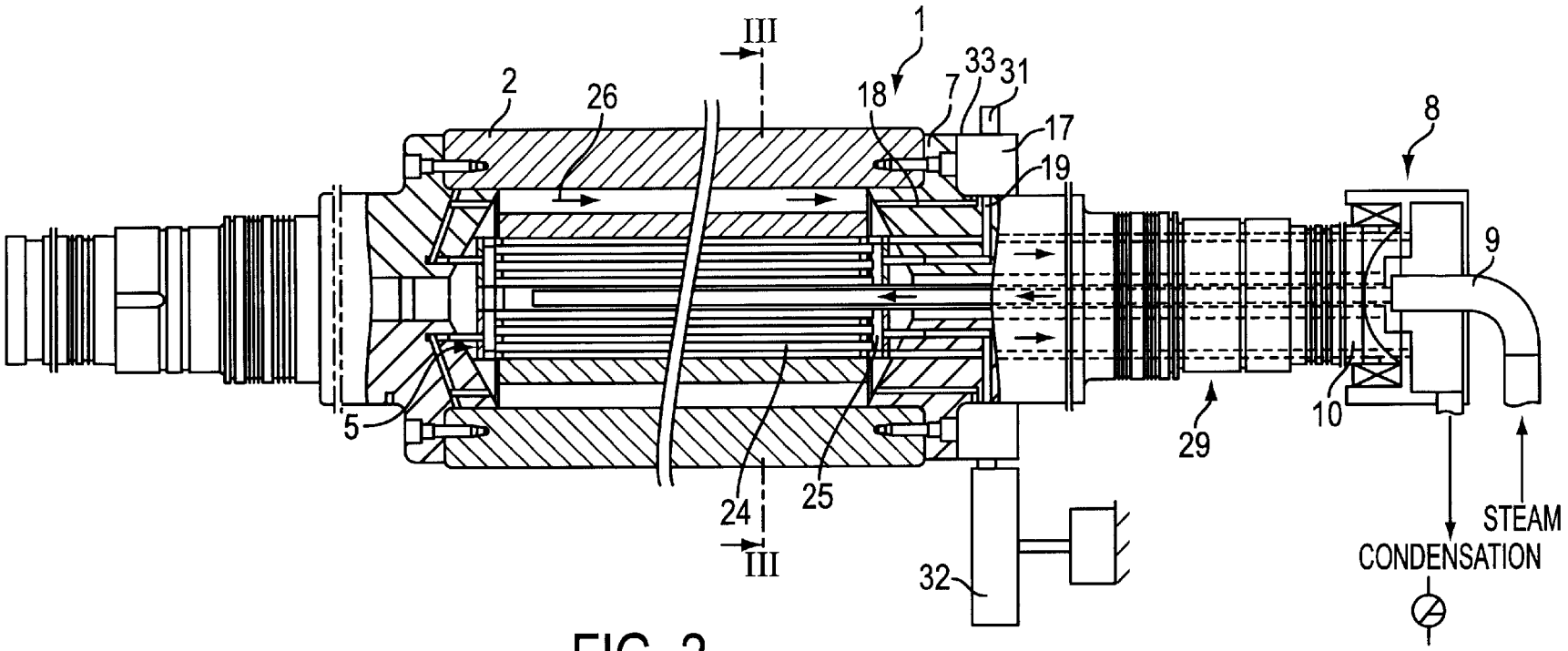
FIG. 2 is a lateral cross-section of another embodiment of the present invention.
Figure 3:
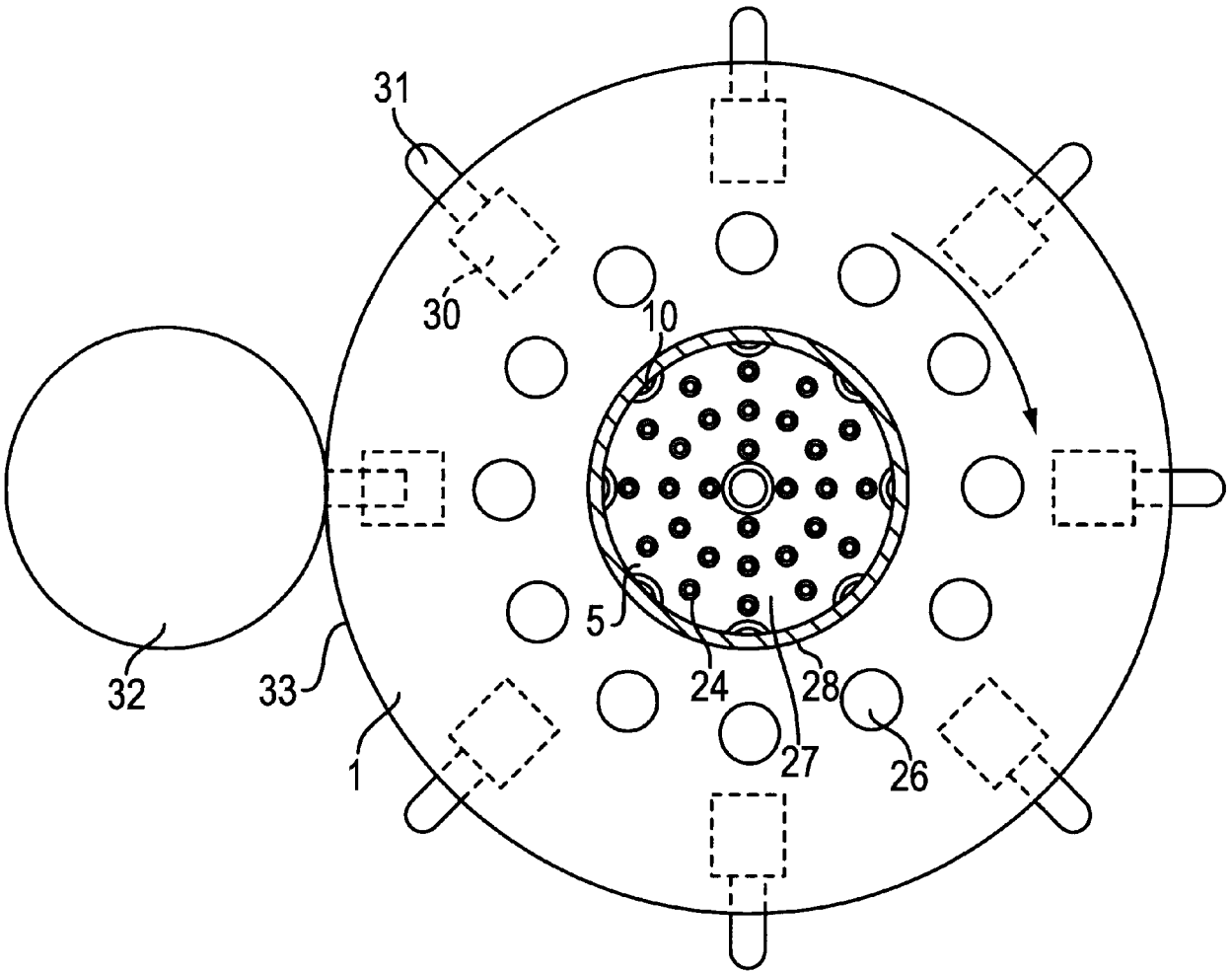
FIG. 3 is a cross-section taken from line III—III in FIG. 2.

Referring now to FIGS. 2 and 3, another embodiment of roll 1, preferably a heating roll, is shown. Like components are referred to with like reference numerals.

In this embodiment, heat exchanger 5 has several tubes 24, suspended inside a chamber 27, through which internal heat transfer fluid 20 (preferably water) flows. Distribution spaces 25 are provided at the ends of tubes 24 to receive internal heat transfer fluid 20 from conduct 19 and uniformly distribute the same in tubes 24. Tubes 24 connect with bores 26 in roll jacket 2. A pump mechanism 17 connects to bores 26 through channel 18, and to distribution space 25 through channel 19. Pumping mechanism 17, channel 19, distribution spaces 25, tubes 24, bores 26, and channel 18 thus define a fluid communication path through which the internal heat transfer fluid 20 circulates.

In this embodiment, an external heat transfer fluid (preferably steam) enters heat exchange chamber 27 through feed line 9. Heat transfers from the external heat transfer fluid through tubes 24 to the cooler internal heat transfer fluid 20. The heat transfer caused the external heat transfer fluid (steam) to condense, which sprays outward to the inner wall of heat exchange chamber 27 by centrifugal force. Condensed steam (i.e., water) collects under the action of the centrifugal force outward, i.e., on the inside of the roll jacket 2, where it returns to supply mechanism 8 through drainage lines 10 under pressure from the incoming steam and the effect of centrifugal force.

With the internal heat transfer fluid 24 heated by the transfer of heat from the external heat transfer fluid, it moves through peripheral bores 26 to heat roll jacket 2. As noted above, bores 26 connect via channel 18 with pump mechanism 17, which in turn pumps the (now cooler) internal heat transfer fluid 20 back to tubes 24.

Cavity 27 forms the primary side of heat exchanger 5, in which the tubes 24 are disposed. As the inner heat transfer fluid 20 flows through tubes 24, condensation tends to form on the outer surface of the tubes. While such condensation would normally interfere with heat transfer, the rotation of tubes 24 throws such condensation off tubes 24. The heat exchanger surfaces are thus "self-cleaning."

In the embodiment of FIGS. 2 and 3, the inflow of the steam takes place centrally, while the outflow of the condensate (the condensed external heat transfer fluid) occurs farther out. However, the discharge line 10 is disposed only far enough out that it fits through a journal 29. The condensation thus does not have to be delivered against the centrifugal force.

As in FIG. 1, pump mechanism 17 preferably includes a plurality of pumps 30, which are preferably piston pumps. Each piston pump has a plunger 31. A friction wheel 32 is in contact with an outside surface 33 of pump mechanism 17. When a plunger comes under the friction wheel 32, it moves inward. When it has passed the friction wheel 32, it is pushed back outward by the force of a reset spring (not shown). Thus, each pump 30 is always actuated once during one rotation. If a plurality of friction wheels 32 are used, it is possible to execute a larger number of pump cycles per rotation.

With a cooling roll, it is possible to obtain uniform heat distribution through the high flow rate in the path of the internal heat transfer fluid. There is no contamination of the roll by deposition of the cooling water. Relatively high quantities of cooling water (external heat transfer fluid) are not required. Rather, only a rotary feed through and a control valve for the amount of cooling water are necessary.

With a heating roll, advantages also result from the use of the pump mechanism 17. Operation is possible even at relatively low temperatures, since condensate can be dealt with without a problem. The condensate of the external heat transfer fluid does not have to be transported radially inward. For the internal heat transfer fluid, transport of condensate is possible without difficulties using the pump arrangement. Accordingly, no transport of condensate using entraining steam, which complicates control and increases energy consumption, is necessary. The heat exchanger is highly efficient since it is self-cleaning. Here again, it is possible to use a relatively simple introduction of rotation. Pump output is similarly dependent on the speed of rotation.

Although the above embodiments have been described with particular reference to cooling and heating a roll, the invention is not so limited. Both structures can be used for both cooling and heating purposes.

The particulars shown herein are by way of example and for purposes of illustrative discussion of the exemplary embodiments of the present invention only, and represents in the cause of providing what is believed to be the most useful and readily understood description of the principles and conceptual aspects of the invention. In this regard, no attempt is made to show structural details of the invention in more detail than necessary for the fundamental understanding of the invention, the description taken with the drawings making apparent to those skilled in the art how the several forms of the invention may be embodied in practice.

What is claimed is:

1. A roll comprising:

a roll jacket;

a heat exchanger mounted inside said roll jacket;

a supply mechanism controlling an inflow and outflow of an external heat transfer fluid to a primary side of said heat exchanger;

an internal heat transfer fluid having a fluid path between an inner portion of said roll jacket and a secondary side of the heat exchanger; and a pump mechanism that pumps said internal heat transfer fluid over said fluid path, said pump mechanism comprising at least one pump, aligned with an outmost radial portion of said fluid path.

2. A roll for processing a material web comprising:

a roll jacket;

a heat exchanger mounted inside said roll jacket, said heat exchanger comprising a feed tube centrally disposed in said roll jacket and a discharge tube mounted about said feed tube;

a supply mechanism controlling an inflow and outflow of an external heat transfer fluid to a primary side of said heat exchanger;

an internal heat transfer fluid having a fluid path between an inner portion of said roll jacket and a secondary side of the heat exchanger; and a pump mechanism that pumps said internal heat transfer fluid over said fluid path.

3. The roll of claim 2, wherein the pump mechanism is attached to said roll and rotates therewith.

4. The roll of claim 2, wherein said pump mechanism is disposed on one end of said roll.

5. The roll of claim 2, wherein said pump mechanism encircles a roll journal.

6. The roll of claim 2, said pump mechanism comprising at least one pump, aligned with an outmost radial portion of said fluid path.

7. The roll of claim 6, wherein said at least one pump has an externally actuable working element.

8. The roll of claim 7, wherein said working element cooperates during rotation of said roll with a stationary drive mechanism to induce pumping action.

9. The roll of claim 2, said supply mechanism further comprising a centrally disposed feed path along which said external heat transfer fluid travels, and a discharge path for discharging said external heat transfer fluid positioned further radially outward than said feed path.

10. The roll of claim 9, further comprising a plurality of tubes mounted inside said heat exchanger, said tubes having an axis parallel to said roll, and which form part of said fluid path.

11. The roll of claim 9, wherein said heat exchanger has a distribution tube, through which the internal heat transfer fluid can flow, which surrounds a flow path of said external heat transfer fluid, whereby said distribution tube has a plurality of openings, which are distributed in a circumferential direction and an axial direction of said roll jacket.

12. A roll for processing a material web comprising:

a roll jacket;

a heat exchanger mounted inside said roll jacket;

a distribution tube surrounding said heat exchanger, said distribution tube having at least one hole along a circumference thereof; and a pump mechanism adapted to circulate an internal heat transfer fluid from said roll jacket to said distribution tube, wherein an outer surface of said distribution tube is a heat transfer interface between said internal heat transfer fluid and an external heat transfer fluid.

13. The roll of claim 12, said pump mechanism further comprising a plurality of pumps mounted in a ring about said roll jacket.

14. The roll of claim 12, wherein said heat exchanger rotates with said roll jacket.

15. The roll of claim 12, wherein said distribution tube rotates with said roll jacket.

16. The roll of claim 12, said heat exchanger further comprising a feed tube centrally disposed in said roll jacket, and a discharge tube mounted about said feed tube, wherein an outer surface of said discharge tube is a heat transfer interface between said internal heat transfer fluid and an external heat transfer fluid.

17. The roll of claim 12, wherein rotation of said roll jacket operates said pumping mechanism.

18. The roll of claim 17, wherein an operational speed of said pumping mechanism is proportional to a rotational speed of said roll jacket.

19. A roll for processing a material web comprising:

a roll jacket;

a heat exchanger mounted inside said roll jacket;

a supply mechanism controlling an inflow and outflow of an external heat transfer fluid to a primary side of said heat exchanger;

an internal heat transfer fluid having a fluid path between an inner portion of said roll jacket and a secondary side of the heat exchanger; and a pump mechanism that pumps said internal heat transfer fluid over said fluid path, wherein said pump mechanism encircles a roll journal.

20. A roll for processing a material web comprising:

a roll jacket;

a heat exchanger mounted inside said roll jacket;

a supply mechanism controlling an inflow and outflow of an external heat transfer fluid to a primary side of said heat exchanger, said supply mechanism further comprising a centrally disposed feed path along which said external heat transfer fluid travels, and a discharge path for discharging said external heat transfer fluid positioned further radially outward than said feed path;

an internal heat transfer fluid having a fluid path between an inner portion of said roll jacket and a secondary side of the heat exchanger; and a pump mechanism that pumps said internal heat transfer fluid over said fluid path.

21. The roll of claim 20, wherein said heat exchanger has a distribution tube, through which the internal heat transfer fluid can flow, which surrounds a flow path of said external heat transfer fluid, whereby said distribution tube has a plurality of openings, which are distributed in a circumferential direction and an axial direction of said roll jacket.

22. A roll for processing a material web comprising:

a roll jacket;

a heat exchanger mounted inside said roll jacket, said heat exchanger comprising a feed tube centrally disposed in said roll jacket, and a discharge tube mounted about said feed tube;

a distribution tube surrounding said heat exchanger, said distribution tube having at least one hole along a circumference thereof; and a pump mechanism adapted to circulate an internal heat exchange fluid from said roll jacket to said distribution tube, wherein an outer surface of said discharge tube is a heat transfer interface between said internal heat transfer fluid and an external heat transfer fluid.

23. A roll for processing a material web comprising:

a roll jacket;

a heat exchanger mounted inside said roll jacket;

a distribution tube surrounding said heat exchanger, said distribution tube having at least one hole along a circumference thereof; and a pump mechanism adapted to circulate an internal heat exchange fluid from said roll jacket to said distribution tube, wherein rotation of said roll jacket operates said pumping mechanism.

24. A roll for processing a material web comprising:

a roll jacket;

a heat exchanger mounted inside said roll jacket, said heat exchanger comprising a centrally disposed discharge tube and a feed passage disposed within said discharge tube;

a supply mechanism controlling an inflow and outflow of an external heat transfer fluid to a primary side of said heat exchanger;

an internal heat transfer fluid having a fluid path between an inner portion of said roll jacket and a secondary side of the heat exchanger; and a pump mechanism that pumps said internal heat transfer fluid over said fluid path, wherein an outer surface of said discharge tube is a heat transfer interface between said internal heat transfer fluid and said external heat transfer fluid.

25. A roll for processing a material web comprising:

a roll jacket;

a heat exchanger mounted inside said roll jacket, said heat exchanger comprising a feed tube centrally disposed in said roll jacket and a discharge tube mounted about said feed tube;

a distribution tube surrounding said heat exchanger, said distribution tube having at least one hole along a circumference thereof; and a pump mechanism adapted to circulate an internal heat exchange fluid from said roll jacket to said distribution tube.

26. A roll comprising:

a roll jacket;

a heat exchanger mounted inside said roll jacket;

a distribution tube surrounding said heat exchanger, said distribution tube having at least one hole along a circumference thereof; and a pump mechanism adapted to circulate an internal heat transfer fluid from said roll jacket to said distribution tube, said pump mechanism comprising a plurality of pumps mounted in a ring about said roll jacket, wherein an outer surface of said distribution tube is a heat transfer interface between said internal heat transfer fluid and an external heat transfer fluid.

* * * * *